US005547137A

United States Patent [19]

Rüth et al.

[11] Patent Number: 5,547,137

[45] Date of Patent: Aug. 20, 1996

[54] BOBBIN WINDING MACHINE WITH A MULTIPLICITY OF WINDING STATIONS

[75] Inventors: Gregor Rüth; Ulrich Wirtz, both of Mönchengladbach; Leo Tholen, Heinsberg, all of Germany

[73] Assignee: W. Schlafhorst AG & Co., Moenchengladbach, Germany

[21] Appl. No.: 273,392

[22] Filed: Jul. 11, 1994

[30] Foreign Application Priority Data

Jul. 9, 1993 [DE] Germany ..... 43 22 952.2

[51] Int. Cl.[6] ..... B65H 54/02; B65H 69/04

[52] U.S. Cl. ..... 242/35.5 R; 242/35.6 E

[58] Field of Search ..... 242/35.5 R, 35.6 E, 242/35.5 A

[56] References Cited

U.S. PATENT DOCUMENTS 4,901,931 2/1990 Mista .

FOREIGN PATENT DOCUMENTS 627924 3/1936 Germany .
1560438 5/1971 Germany .
2449675 4/1975 Germany .
2919768 11/1980 Germany .
3812643 11/1988 Germany .
1113853 5/1968 United Kingdom .

OTHER PUBLICATIONS

Japanese Utility Model No. 39–33193, dated May 8, 1963.

*Primary Examiner*—Michael R. Mansen
*Attorney, Agent, or Firm*—Herbert L. Lerner; Laurence A. Greenberg

[57] ABSTRACT

A bobbin winding machine includes a multiplicity of winding stations for rewinding spinning cops. Each of the winding stations has a bobbin magazine for holding the cops and a bottle-like unwinding chamber having a bearing shaft and an arbor being pivotable about the bearing shaft. The unwinding chamber surrounds a cop being fixed on the arbor during unwinding. At least a portion of the unwinding chamber is formed by a cop chute being pivotable between a cop transfer position and an unwinding position. The unwinding chamber has a shell partly encompassing a cop during unwinding.

10 Claims, 5 Drawing Sheets

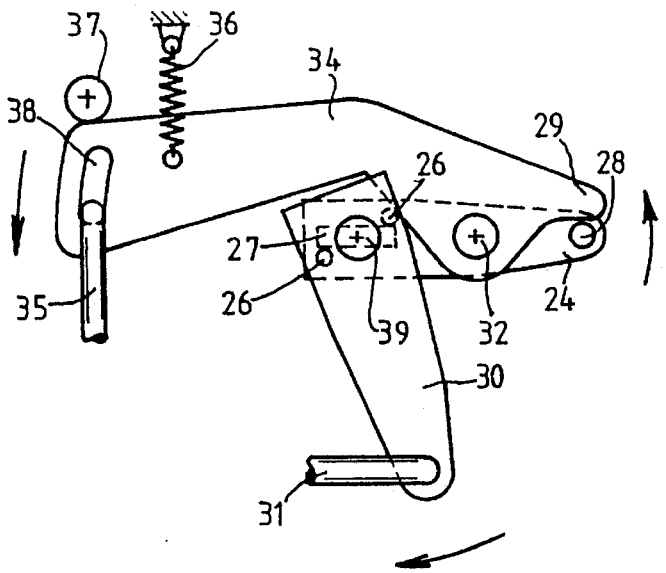
FIG. 3
FIG. 4
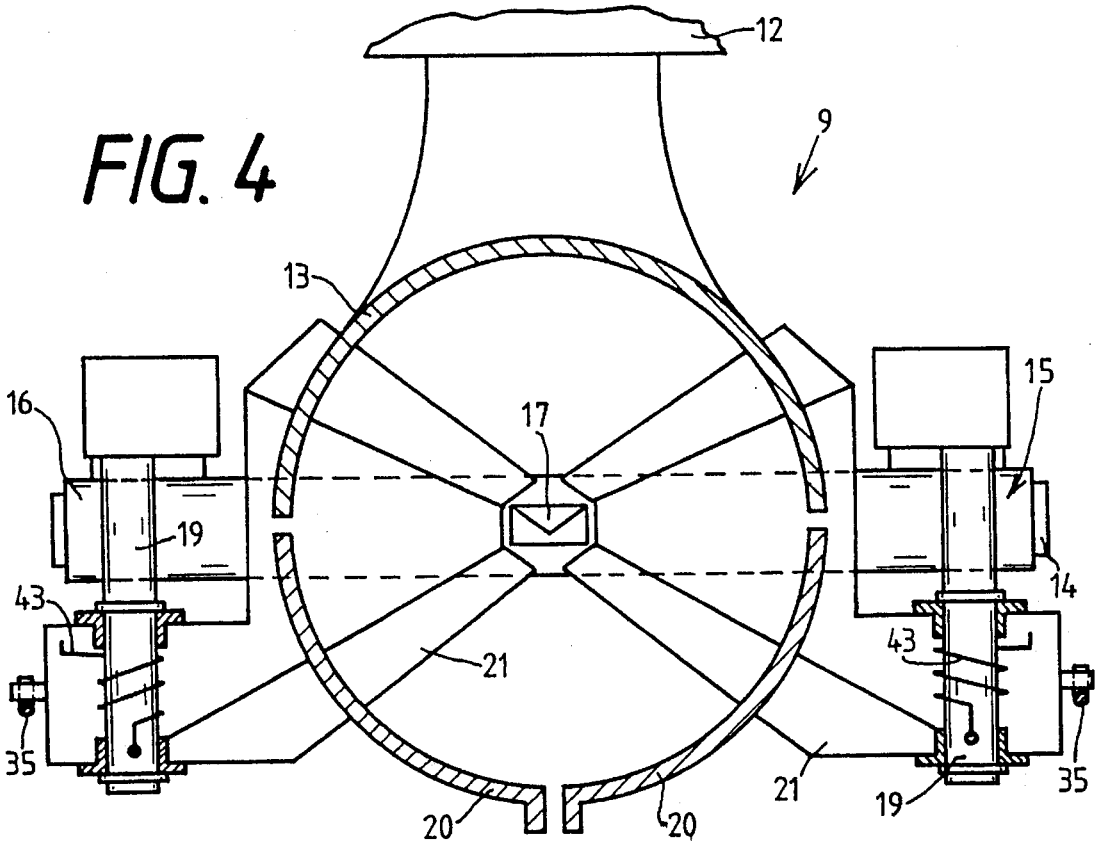

BOBBIN WINDING MACHINE WITH A MULTIPLICITY OF WINDING STATIONS

BACKGROUND OF THE INVENTION

Field of the Invention

The invention relates to a bobbin winding machine with a multiplicity of work stations for rewinding spinning cops, in which a bobbin magazine, a cop chute, an arbor pivotable about a bearing shaft, and a shell partly encompassing the cop during unwinding, are provided in the region of each work station.

Bobbin winding machines of that generic type are known, for instance, from German Published, Non-Prosecuted Application DE-OS 29 19 768 or German Published, Prosecuted Application DE-AS 1 560 438. Those patent applications relate to automatic bobbin winders in which spinning cops are held ready for the rewinding process in bobbin storage means that are constructed as a round magazine. The spinning cops travel from the bobbin magazine over a cop chute to a pivotably supported arbor. The arbor, along with the spinning cops, pivots out of the receiving position to a working position. In the working position, the spinning cops are then rewound to make cross-wound bobbins, which are also known as cheeses.

In the apparatus of German Published, Non-Prosecuted Application DE-OS 29 19 768, the spinning cops are also disposed in a trapezoidal depression during the rewinding process. The depression partly encompasses the spinning cops and communicates through connecting openings with a dust removal device.

It is also known for the spinning cop to be disposed during the rewinding process in an unwinding chamber that is closed to the greatest possible extent.

Japanese Utility Model No. 39-33193, for instance, shows such an unwinding chamber, which has a stationary, flat rear part and laterally hinged door elements.

A bobbin winding machine which is also described in British Patent No. 1,113,853, has unwinding chambers that completely envelop the spinning cops during the unwinding process. The unwinding chambers, which are equipped with telescoping wall parts, are connected in that case to a dust removal device belonging to the machine itself, through openings disposed in the bottom region of the chambers.

SUMMARY OF THE INVENTION

It is accordingly an object of the invention to provide a cross-wound bobbin or cheese-producing textile machine, which overcomes the hereinafore-mentioned disadvantages of the heretofore-known devices of this general type and which further improves the winding stations of such textile machines.

With the foregoing and other objects in view there is provided, in accordance with the invention, a bobbin winding machine, comprising a multiplicity of work or winding stations for rewinding spinning cops, each of the winding stations having: a bobbin magazine for holding the cops; and a bottle-like unwinding chamber having a bearing shaft, an arbor being pivotable about the bearing shaft, the unwinding chamber surrounding a cop being fixed on the arbor during unwinding, at least a portion of the unwinding chamber being formed by a cop chute being pivotable between a cop transfer position and an unwinding position, and the unwinding chamber having a shell partly encompassing a cop during unwinding.

Advantageously, during the rewinding process the spinning cops are disposed in the bottle-like unwinding chamber that maximally encompasses the spinning cop during the rewinding process. The unwinding chamber or parts thereof are pivotable between the cop receiving position and the unwinding position.

This kind of structure offers the advantage of enabling the structural effort and expense for the apparatus to be relatively slight, since the unwinding chamber or a part of it is used as a transport device, in order to carry the spinning cops arriving from the bobbin storage means to the arbor, and on the other hand is a component of a shielding device through which dust removal from the cops can be optimized.

Through the use of the bottle-like unwinding chamber, the unavoidable production of dust or fluff that occurs during unwinding of the cops can be limited to a relatively small space, so that the volumetric flow per unit of time expected for proper dust removal can be reduced by approximately half.

In accordance with another feature of the invention, the unwinding chamber is constructed as a multiple-part component having a shell-like rear part connected to the dust removal device being fixedly disposed on the winding station housing, while a front part constructed as a cop chute is pivotable about a bearing shaft.

An efficient suction device is created by directly connecting the dust removal device to the rear part. In accordance with a further feature of the invention, the efficiency of the device is greatest, if a connection opening disposed in the rear part for the dust removal device discharges in the region of a yarn draw-off accelerator.

In accordance with an added feature of the invention, part of the unwinding chamber has a carrier element with chute flaps for transferring the spinning cops, centering flaps for positioning them, and the arbor for fixing them.

In accordance with a concomitant feature of the invention, the shell parts of the chute flap, which are secured in hinged fashion to fittings of the carrier element, and the centering flaps which are disposed pivotably on bearing journals, are triggered separately through a common control lever, since the chute flaps are acted upon in a clockwise rotation of the control lever, while the centering flaps are acted upon in a counterclockwise rotation thereof.

Due to its relatively simple structural layout and its sturdy construction, the unwinding chamber according to the invention represents a component that overall is quite compact and has little likelihood of malfunction, and which on one hand assures satisfactory transfer of the spinning cops from the round magazine to the arbor while on the other hand markedly improves the efficiency of the dust removal device of the bobbin winder.

Other features which are considered as characteristic for the invention are set forth in the appended claims.

Although the invention is illustrated and described herein as embodied in a cross-wound bobbin or cheese-producing textile machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 3 is a further enlarged, fragmentary, front-elevational view of a portion II of FIG. 2, showing an actuating mechanism for chute flaps and centering flaps;

FIG. 4 is a fragmentary, sectional view of the spinning cop unwinding chamber which is taken along a line IV—IV of FIG. 1, in the direction of the arrows;

DESCRIPTION OF THE PREFERRED EMBODIMENTS

Figure 1:
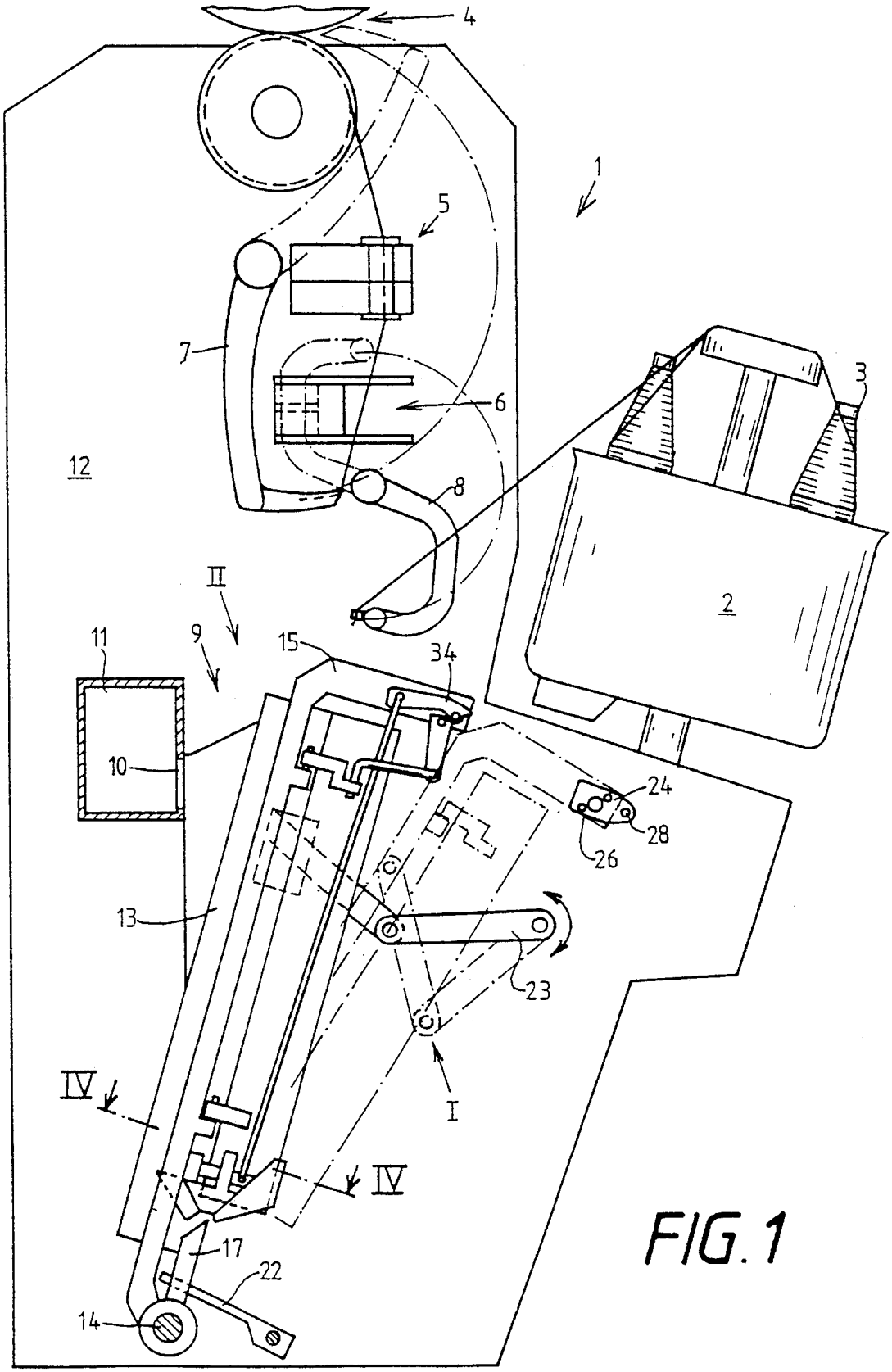
FIG. 1 is a fragmentary, diagrammatic, front-elevational view of a winding station of a cheese-producing textile machine, with a spinning cop unwinding chamber according to the invention.

Referring now to the figures of the drawing in detail and first, particularly, to FIG. 1 thereof, there is seen a winding station 1 which is a component of an automatic bobbin winder having a number of such work stations. Among other elements, each winding station 1 has a round magazine 2 for storing spinning cops, a winding device 4 for winding cross-wound bobbins or cheeses, an electric yarn cleaner 5, and a splicer 6. Yarns to be joined are delivered to the splicer 6 by suction tubes 7 and 8. Since the structure and function of such winding stations is generally known, further description will be dispensed with.

During a rewinding process, spinning cops 3 are disposed in a bottle-like unwinding chamber 9. The unwinding chamber 9 or a portion thereof is pivotable between a cop receiving position I and an unwinding position II. The unwinding chamber also communicates through an aspiration opening 10, in the region of a yarn draw-off accelerator 40' (FIG. 2) with a dust removal device or conduit 11 that is part of the machine itself.

Figure 2:
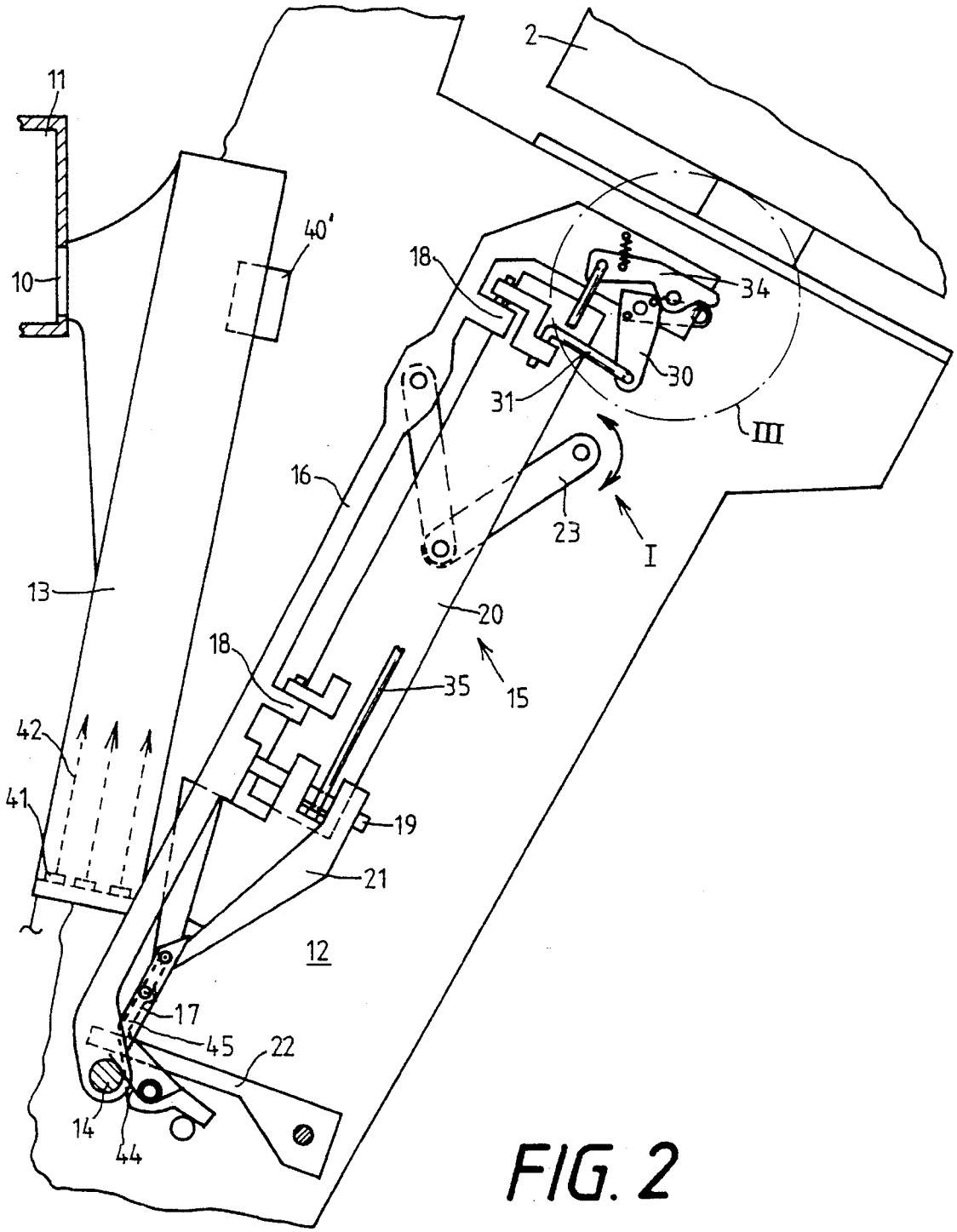
FIG. 2 is an enlarged, fragmentary, front-elevational view of the unwinding chamber in a cop transfer position.

As is seen particularly from FIG. 2, the unwinding chamber 9 has a shell-like rear part 13 which is disposed in such a way as to be fixed to the winding station housing 12, and a front part 15 that can be pivoted about a bearing shaft 14. The front part 15 has an essential component in the form of a carrier element 16, on which a cop attachment or slip-on arbor 17 and mounting elements 18, 19 for chute flaps 20 and centering flap 21 are disposed. A separately triggerable tube ejector 22 is also provided in the region of the cop arbor 17 disposed toward the bottom.

The carrier element 16 is connected through articulated tabs 23 to a non-illustrated drive source installed in the winding station housing 12 and can be pivoted between the cop receiving position I and the unwinding position II, as is suggested in FIG. 1.

Figure 6:
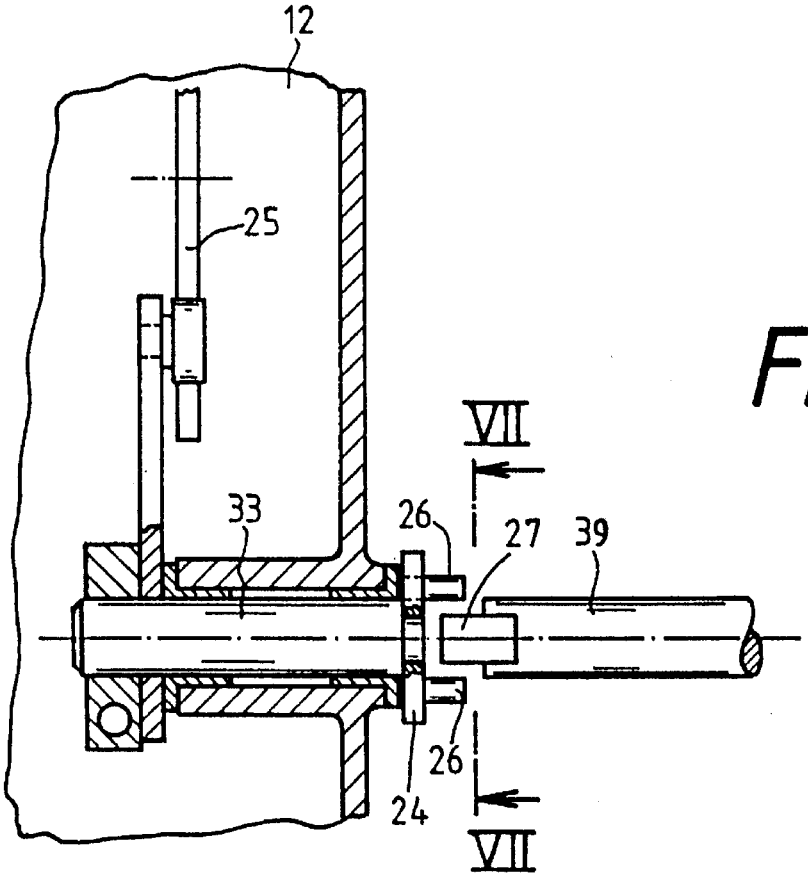
FIG. 6 is an enlarged, fragmentary, side-elevational and sectional view of a control mechanism.
Figure 7:
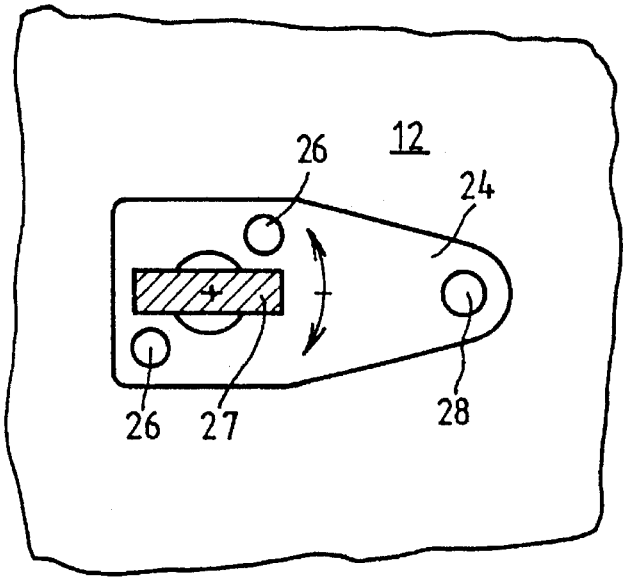
FIG. 7 is a sectional view taken along the line VII—VII of FIG. 6, in the direction of the arrows.

Triggering of the chute flaps 20 or the centering flaps 21 is likewise carried out through the drive source which is disposed in the winding station housing 12. As is suggested in FIG. 6, a trunnion 33, which has a control lever 24 on its end, is acted upon through a cam disk configuration, of which only a cam disk 25 is shown, The control lever 24, which is rotatable clockwise and counterclockwise, has control cams 26 for actuating both a rectangular indexing element 27 and a control stop 28 disposed on the end, as is seen in FIG. 7.

Figure 5:
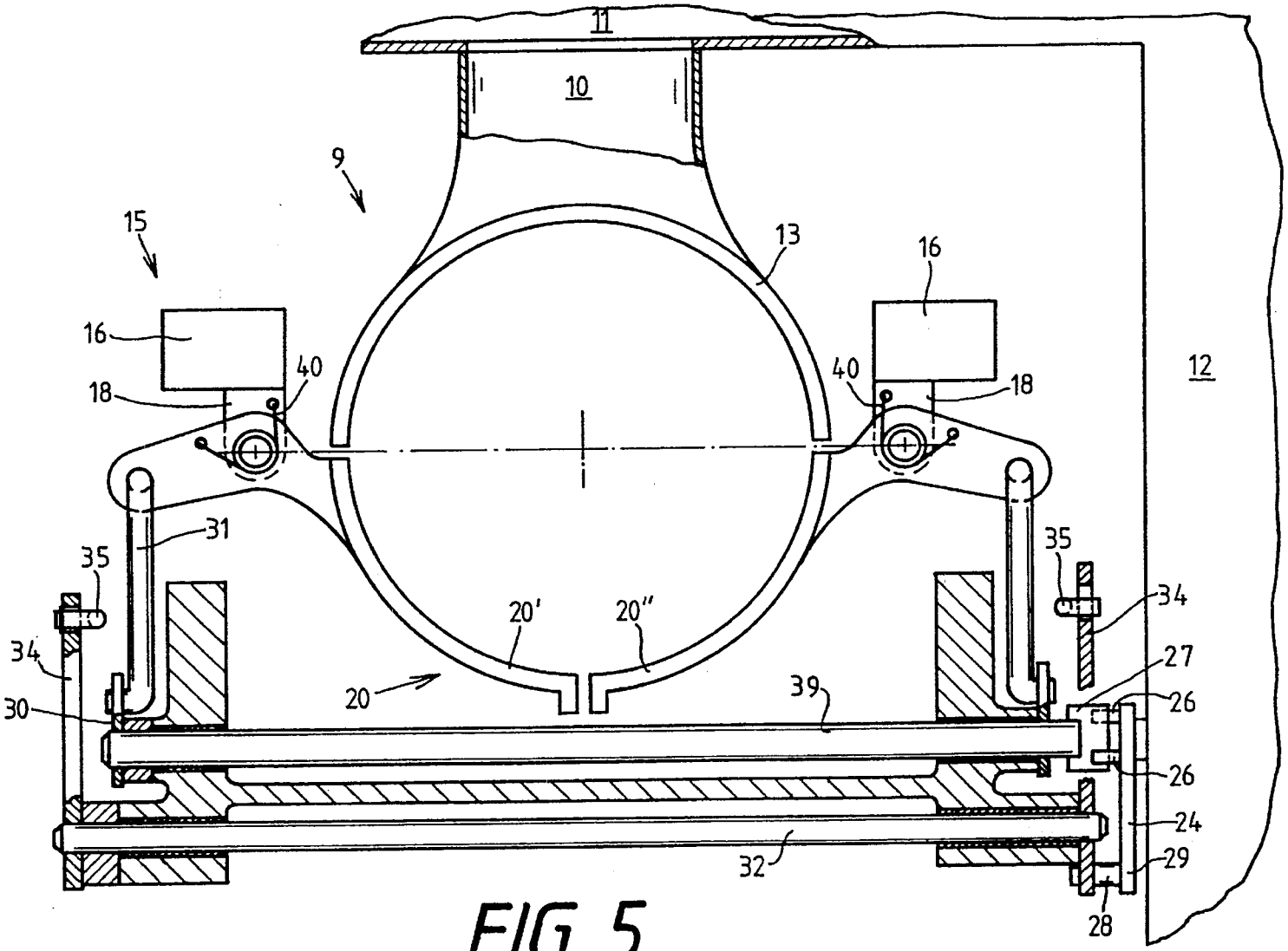
FIG. 5 is a fragmentary, partly sectional, plan view of the spinning cop unwinding chamber.

As is particularly seen from FIGS. 3 and 5, if the control lever 24 is moved clockwise, then the indexing element 27, which is connected to a control shaft 39, is actuated through the control cam 26. Through the use of the control shaft 39 and a lever and linkage configuration 30, 31, the chute flaps 20 are triggerable in a defined fashion.

When the control lever 24 is moved counterclockwise, a protrusion-like extension 29 of a control plate 34 is engaged from beneath by the control stop 28 and is thereupon pivoted about a control shaft 32 as a pivot point. Since the control plate 34 is connected through an oblong slot guide 38 and a linkage 35 to the centering flaps 21, the centering flaps, which in the normal situation are opened by a spring element 36, can be closed in a defined fashion. As is shown in FIGS. 4 and 5, both the chute flaps and the centering flaps are each in the form of structural components on the right and the left. A functional connection among these component units is provided through the control shafts 39 and 32.

As is suggested in FIG. 2, blower nozzles 41 may be provided in the region of the bottom of the unwinding chamber 9, for instance on the rear part 13. Through the use of a blown air stream 42, on one hand the unwinding chamber 9 can be cleaned from the inside. On the other hand, if needed, for instance if a yarn breaks during the unwinding, the end of the yarn resting on the cop can be fed into the region of the suction tube 8 disposed above the unwinding chamber 9.

The apparatus according to the invention functions as follows:

During the winding process, the unwinding chamber 9 is closed and is connected through the suction opening 10 to the dust removal device 11 of the bobbin winder machine. This means that the front part 15 of the unwinding chamber is pivoted into the unwinding position II shown in FIG. 1. In that position, the chute flaps 20 are closed, while the centering flaps 21 are open, in order to prevent any hindrance in the unwinding of the cop.

As soon as the spinning cop 3 has been unwound, the front part 15 of the unwinding chamber is pivoted by the articulated tabs 23, into the cop transfer position I shown in FIG. 2. In that position of the front part 15, both the rectangular indexing element 27 and the control plate 34 are in indexing contact with the control lever 24 that is pivotably connected to the winding station housing 12. Through the use of the control cams 26, rotation of the control lever 24 opens the indexing element 27, the control shaft 39, both the lever 30 and the linkage 31, and the chute flaps 20, so that the empty tubes can be lifted from the arbor 17 and doffed forward by means of the tube ejector 22. Next, the control lever 24 is moved counterclockwise, so that the chute flaps 20 first close again, under the influence of a spring element 40. Upon further counterclockwise rotation of the control lever 24, its control stop 28 engages the indexing protrusion 29 of the control plate 34 from below, which is then pivoted counterclockwise, counter to the force of the spring element 36, about the control shaft 32 as a pivot point. The linkage 35 slides downward with the oblong slot guide 38, and the centering flaps 21 are closed by a cylindrical compression springs 43. If the centering flaps 21 should meet a cop 3 that has mistakenly remained on the arbor 17, then the centering flaps 21 can fold back again because of the oblong slot guides 38, thus averting damage to the machine.

The delivery of a new spinning cop 3 from the bobbin magazine 2 takes place in the known manner, through an opening in a bottom region of the round magazine 2. The cop drops through the opening while being guided by closed shell parts 20', 20" of the chute flap 20 and reaches the region of the centering flaps 21 disposed in the region of the end of the chute and slides onto the arbor 17, having been positioned by the centering flaps 21.

Next, either the control lever 24 is first rotated back to its initial position, or the front part 15 of the unwinding chamber 9 is immediately pivoted into the unwinding position II. In both method steps, the control plate 34 is pulled by the spring element 36 into its basic position on a stop 37, so that the centering flaps 21 are opened. At the same time, during the pivoting motion of the unwinding chamber 9 from the cop transfer position I to the unwinding position II, the cop 3 that is positioned on the arbor 17 is locked. For that purpose, a tensioning lever 45 that is acted upon by a spring element 44 is provided in the region of the arbor 17.

The apparatus which is pivoted back to the unwinding position II is thus ready for a new unwinding process. The new spinning cop can be wound onto a cheese that is held in the winding device 4.

We claim:

1. A bobbin winding machine, comprising:

a multiplicity of winding stations for rewinding spinning cops, each of said winding stations having:

a bobbin magazine for holding the cops; and a bottle-shaped unwinding chamber having a bearing shaft, an arbor pivotally disposed about said bearing shaft, said unwinding chamber surrounding a cop being fixed on said arbor during unwinding, a cop chute pivotally disposed between a cop transfer position for receiving a spinning top from the bobbin magazine, and an unwinding position, and said cop chute forming at least a portion of said unwinding chamber.

2. The bobbin winder according to claim 1, including a winding station housing, and a dust removal device being fixedly disposed on said winding station housing, said unwinding chamber being constructed as a multiple-part component having a rear element connected to said dust removal device and a front part having said cop chute and being pivotably supported about said bearing shaft.

3. The bobbin winder according to claim 2, including a yarn draw-off accelerator, said rear element being said shell and having a connection opening in the region of said yarn draw-off accelerator, said unwinding chamber communicating through said opening with said dust removal device.

4. The bobbin winder according to claim 2, wherein said front part of said unwinding chamber has a carrier element being pivotable about said bearing shaft.

5. The bobbin winder according to claim 4, wherein said chute includes at least one chute flap for transferring a spinning cop and centering flaps for positioning the spinning cop, said at least one chute flap, said centering flaps and said arbor being disposed on said carrier element.

6. The bobbin winder according to claim 5, wherein said carrier element has mounting elements, and said at least one chute flap includes two shell halves being hinged to said mounting elements.

7. The bobbin winder according to claim 6, including bearing journals of said carrier element, and a spring element, said centering flaps being pivotably supported on said bearing journals and being acted upon in an opening direction by said spring element.

8. The bobbin winder according to claim 7, including a control lever, said hinged shell halves of said chute flap and said pivotably supported centering flaps being individually triggerable by said control lever, said chute flaps being triggerable by a clockwise rotation of said control lever and said centering flaps being triggerable by a counterclockwise rotation of said control lever.

9. The bobbin winder according to claim 1, including a dust removal device fixedly disposed relative to and in the vicinity of said unwinding chamber, said dust removal device being operative in a yarn draw-off region above said unwinding chamber.

10. The bobbin winder according to claim 1, including a suction tube, a bottom region of said unwinding chamber, and blower nozzles disposed in said bottom region for supplying a blown air stream to be activated if a yarn breaks for detaching a yarn end from a cop and feeding the yarn end to the region of said suction tube.

* * * * *